US012276473B1

(12) United States Patent
Hellberg

(10) Patent No.: US 12,276,473 B1
(45) Date of Patent: Apr. 15, 2025

(54) SHOTGUN SHELL LOADING AND HOLDING DEVICE

(71) Applicant: Dennis J Hellberg, Triangle, VA (US)

(72) Inventor: Dennis J Hellberg, Triangle, VA (US)

(73) Assignee: Dennis J Hellberg, Triangle, VA (US)

( * ) Notice: Subject to any disclaimer, the term of this patent is extended or adjusted under 35 U.S.C. 154(b) by 0 days.

(21) Appl. No.: 18/481,375

(22) Filed: Oct. 5, 2023

(51) Int. Cl.
*F41A 9/84* (2006.01)
*F41A 9/24* (2006.01)
*F42B 7/00* (2006.01)

(52) U.S. Cl.
CPC .. *F41A 9/24* (2013.01); *F42B 7/00* (2013.01)

(58) Field of Classification Search
CPC ..... F41A 9/35; F41A 9/84; F41A 9/85
See application file for complete search history.

(56) References Cited

U.S. PATENT DOCUMENTS 863,798 A * 8/1907 Hodges ..... F41A 9/84 42/87
2,896,353 A * 7/1959 Hunt ..... F41A 9/85 42/89
3,225,482 A * 12/1965 Olson ..... F41A 9/85 42/89
3,538,636 A * 11/1970 Roth ..... F42B 39/26 42/87
4,507,889 A * 4/1985 Allen ..... F41A 9/85 42/89
4,843,649 A 7/1989 Jewell et al.
4,869,009 A * 9/1989 Bennett ..... F41A 9/84 42/87
D361,513 S 8/1995 Adami et al.
5,924,613 A 7/1999 Johnson et al.
D491,465 S 6/2004 Kelleghan
8,931,633 B2 1/2015 Martin, III
D730,475 S 5/2015 Iannello et al.
9,038,817 B2 5/2015 Connolly et al.
9,103,626 B1 * 8/2015 Heizer ..... F41A 3/00
9,651,347 B2 * 5/2017 Rodriguez ..... A45F 5/021
9,733,053 B2 8/2017 Olroyd
10,209,018 B1 * 2/2019 Yaxley ..... F41A 9/85
10,222,156 B2 * 3/2019 Head ..... F42B 39/02
2010/0313460 A1 * 12/2010 Tucker ..... F41A 9/83 42/87
2013/0199070 A1 * 8/2013 Heizer ..... F41A 9/84 42/71.01
2014/0124387 A1 5/2014 Iannello et al.
2022/0057155 A1 * 2/2022 Lyle ..... F41A 9/85

* cited by examiner

*Primary Examiner* — Derrick R Morgan
(74) *Attorney, Agent, or Firm* — Argus Intellectual Enterprise, LLC; Jordan Sworen; Daniel Enea

(57) ABSTRACT

A device for holding and loading shotgun shells is provided. The device includes a resilient pad having a front side with a pair of openings for receiving, retaining, and releasing a pair of shells into the barrel of a shotgun. The openings include a plurality of expansion joints to assist with the loading and unloading of shells into a gun. An annular groove extends around a base of each opening for resiliently and frictionally retaining the rim of a shell therein. An opposing end of the pad includes a laterally projecting tab portion formed with an aperture therethrough for a user of the holding device to manually grasp and manipulate said device. The expansion joints and material of the pad facilitate the insertion and release of the shells, whereas the groove and size of the openings serve to frictionally retain the shells within the device.

10 Claims, 3 Drawing Sheets

SHOTGUN SHELL LOADING AND HOLDING DEVICE

BACKGROUND OF THE INVENTION

The present invention relates to ammunition loading devices. More specifically, the present invention provides a shotgun shell loading and holding device for quick direct insertion of shotgun shells into a double barrel shotgun by using a combination of material components and operational functionality.

The term 'shotgun' refers to a long-barreled firearm generally used for short distances and offers a variety of shells/cartridge/ammunition measured by gauge. Double barrel shotguns are configured with the two barrels either set side-by-side (SxS) or stacked with one barrel over and one barrel under (O/U) models. Regardless of configuration, double barrel shotguns are actively used for hunting, safety, security, and competitive shooting—most notably at the Olympics. Historically, double barrel shotguns have been used by civilians, military, and law enforcement servicemembers since the 19th century. "Coach Gun" terminology has long since been associated with the use of a short double barrel shotgun on stagecoaches and considered both a defensive tool and deterrent to robbers at close range. To date, double barrels have a simple operational platform with limited moving parts and high reliability. And while newer shotgun technologies are also considered reliable, they have been unable to replace the double barrel due to its simplicity, safety, and performance.

Double barrels have a simplicity not shared with the pump, lever action and semi-automatic shotguns as they do not rely on a mechanical reloading action for the second shot. Double barrels have fewer moving parts than other types of multiple-shell shotguns, thus lessening the chance of breaking. Furthermore, loading at the break with two shots significantly reduces the potential mechanical actions that cause jamming and/or feeding failures. Double barrel shotguns with two independently functioning triggers-one per barrel-provide the fastest follow-up shot and can also be done simultaneously. Because of these features, the double barrel's simple design has fundamentally proven to be reliable across its lifetime and will presumably continue to do so. For many, safety is the most significant advantage of the double barrel shotgun. The break-action design is widely considered the safest shotgun design and allows the shooter to simply open the breech to make it harmless. This also signals to others the barrels are in a safe position.

In contrast to the many advantages the double barrel shotgun provides, its primary disadvantage is the time it takes to reload. Reloading is done manually and sequentially for both barrels. Loading and reloading a double barrel both quickly and effectively, however, takes a considerable amount of practice and technique-all of which can easily become an obstacle should situational conditions change. For example, inclement weather (increased or severe heat, cold, snow, rain), conditions that may affect or limit use due to dirt, sweat, or injury; and restricted or blocked access to the shells if they are in the shooters pocket, vest or a belt and other designed holsters/holders for the shells can present obstacles for well-practiced double barrel shotgun users. Therefore, there is a need for a device that allows users to load and reload double barrel shotguns quicker and more conveniently.

In light of the devices disclosed in the known art, it is submitted that the present invention substantially diverges in design elements and methods from the known art and consequently it is clear that there is a need in the art for an improvement for a shotgun shell loading and holding device. In this regard the instant invention substantially fulfills these needs.

SUMMARY OF THE INVENTION

In view of the foregoing disadvantages inherent in the known types of shotgun shell loading and holding devices now present in the known art. The present invention provides a new shotgun shell loading and holding device wherein the same can be utilized for receiving, retaining, and releasing a pair of shells into the barrel of a shotgun.

It is an objective of the present invention to provide shotgun shell loading and holding device comprising an elastomeric pad configured to flex having a front side, a rear side and a sidewall extending therebetween. A pair of openings are disposed on the front side of the pad, wherein each opening is configured to receive, retain, and release a shotgun shell into a barrel of a shotgun.

It is an objective of the present invention to provide an embodiment of the shotgun shell loading and holding device comprising a laterally projecting tab portion is formed with an aperture therethrough at an upper end of the pad.

It is an objective of the present invention to provide an embodiment of the shotgun shell loading and holding device comprising a plurality expansion joints disposed equidistance from one another around a circumference of an upper rim of each opening and a laterally extending annular groove formed within a base of each opening for resiliently and frictionally retaining the rim of a shell therein.

It is another objective of the present invention to provide an embodiment of the shotgun shell loading and holding device configured to facilitate the organization, storage/holding, staging and fluidity of reloading top break, breech-loading shotguns. The device is configured to provide a quick and safe reloading option by decreasing load time, thereby improving follow-on shots for a myriad of hunting, security, and sporting use.

It is yet another objective of the present invention to provide an embodiment of the shotgun shell loading and holding device comprising a 360 degree, fully-circumferentially extending recess that covers and protects the firing primer to prevent accidental discharges—thus saving life, limb and property; vertically extending walls that allow for safe carry—an improvement to the current "saddle side mount and butt stock carrying" sleeves and mounts; expansion joints to aid with shell placement into the device and release of both shells into the barrels; laterally extending annular basal grooves; a gripping handle; and resilient elastomeric material.

It is therefore an object of the present invention to provide a new and improved shotgun shell loading and holding device, that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
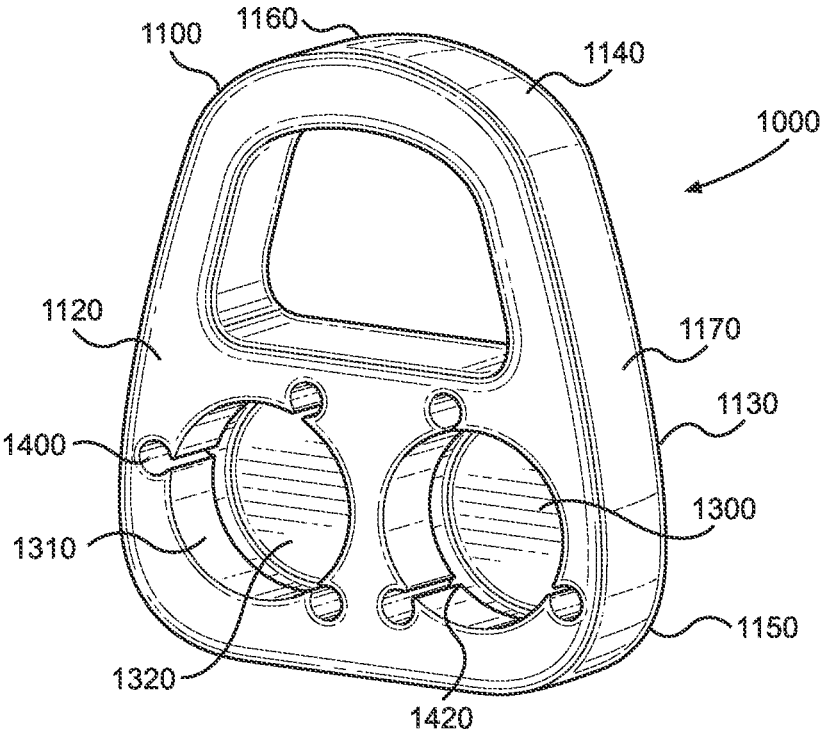
FIG. 1 shows a perspective view of an embodiment of the shotgun shell loading and holding device.

Reference is made herein to the attached drawings. Like reference numerals are used throughout the drawings to depict like or similar elements of the shotgun shell loading and holding device. For the purpose of presenting a brief and clear description of the present invention, the embodiment discussed will be used for receiving, retaining, and releasing a pair of shells into the barrel of a shotgun. The figures are intended for representative purposes only and should not be considered to be limiting in any respect. Furthermore, the described features, structures, or characteristics may be combined in any suitable manner in one or more embodiments. In the following description, numerous specific details are provided to give a thorough understanding of embodiments.

Reference will now be made in detail to the exemplary embodiment(s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

Figure 2:
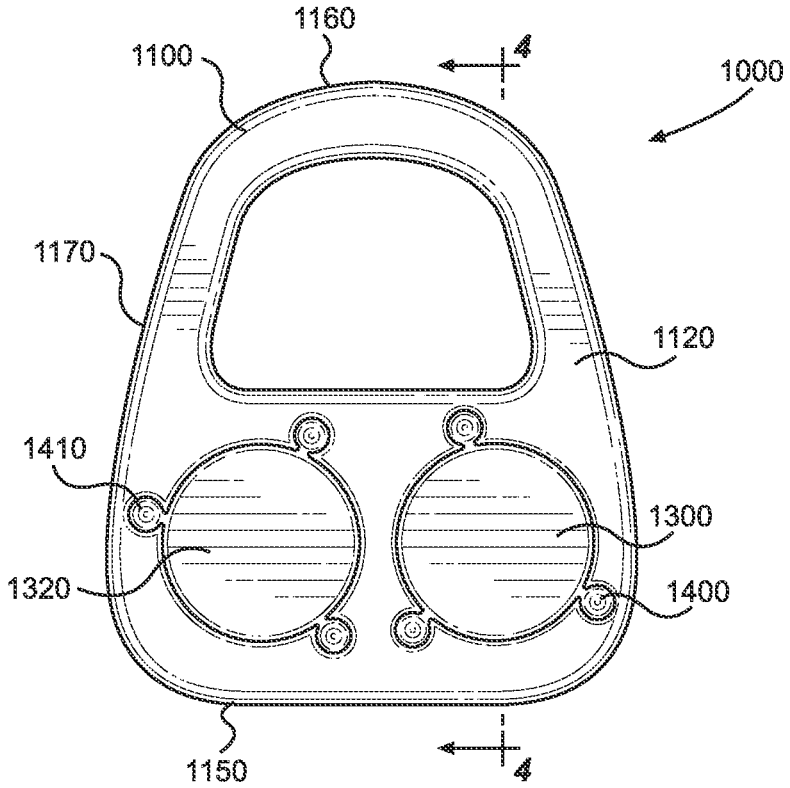
FIG. 2 shows a front view of an embodiment of the shotgun shell loading and holding device.

Referring now to FIGS. 1 and 2, there is shown a perspective view and a front view of an embodiment of the shotgun shell loading and holding device, respectively. The shotgun shell loading and holding device 1000 comprises a pad 1100 having a front side 1120, a rear side 1130, and a sidewall 1140 extending therebetween. In the illustrated embodiment, a first side 1150 of the pad 1100 is flat, wherein an opposing second side 1160 tapers and is rounded. The flat first side 1150 allows the pad 1100 to remain upright when the sidewall 1140 rests on a horizontal surface. In the illustrated embodiment, the sidewall 1140 extends entirely around the pad 1100 and comprises a uniform width therearound. In some embodiments, a length of the pad 1100 is substantially similar to a width of a double barrel of a shotgun, wherein the length of the pad is measured between the lateral sides thereof and the width of the pad 1100 is measured between the front and the rear side thereof.

The device comprises a pair of openings 1300 disposed on the front side 1120 for receiving, retaining, and releasing a pair of shells into the barrel of a shotgun. In the illustrated embodiment, each opening is disposed along a same lateral axis extending between lateral sides 1170 of the pad 1100. In alternate embodiments, the openings are disposed along a same longitudinal axis extending between the first and second sides of the pad 1100. A space between each opening is configured to align with and be substantially the same size as a space between the barrels of the shotgun such that the shells are aligned with each opening of the barrel when disposed within the openings. In the illustrated embodiment, the openings 1300 are circular and sized to receive a shotgun shell therein, wherein each opening 1300 comprises a floor 1320 and vertical wall 1310 recessed within the pad 1100. The floor 1320 prevents the shell from passing through the pad 1100. However, in alternate embodiments, the opening does not comprise a floor. In some embodiments, the floor is positioned at a distance between the front side and the rear side, such that the receiving, retention, and ejection of the shells therefrom is specific to the particular shotgun and/or shell. In another embodiment, the floor is removable and adapted to be adjusted in position such that the floor engages with the (interior wall) via a series of annular channels.

In the illustrated embodiment, each opening 1300 includes a plurality of expansion joints 1400 disposed around an upper rim 1330 of the opening 1300. In the shown embodiment, the device 1000 comprises three expansion joints 1400 that are not equidistance from one another. Further, in the illustrated embodiment, the first opening comprises three expansion joints having a different spacing and position than the three expansion joints disposed within the second opening. In alternate embodiments, the expansion joints are equidistance and separated by 120 degrees along the circumference of the upper rim. In other embodiments, the device comprises a single expansion joint, whereas in some embodiments, the device comprises more than three expansion joints. In alternate embodiments, each opening comprises the same number of expansion joints having the same spacing between one another.

The expansion joints 1400 are configured to assist with the flexibility of the pad 1100 to release a shell from an opening 1300. In the illustrated embodiment, each expansion joint 1400 comprises an open ring 1410 having a slot 1420 that extends along the vertical wall 1310. In the illustrated embodiment, the slot 1420 extends an entire length of the vertical wall 1310. The opening of the ring 1410 and slot 1420 is faced towards a center of the opening 1300. In this way, when the shells are forced out from the openings 1300, the open spaces of the ring 1410 and the slot 1420 become widened, thereby widening the circumference of each opening and allowing the shell to be removed therefrom.

In some embodiments, the pad 1100 comprises a substantially rectangular shape, wherein other embodiments, the pad comprises any suitable shape configured to support a pair of shotgun shells therein. In the illustrated embodiment, the pad 1100 is composed of an elastomer or other suitable elastic material. In this way, the pad 1100 is configured to flex and comprise resiliency when receiving and releasing the shells from the openings 1300.

Figure 3:
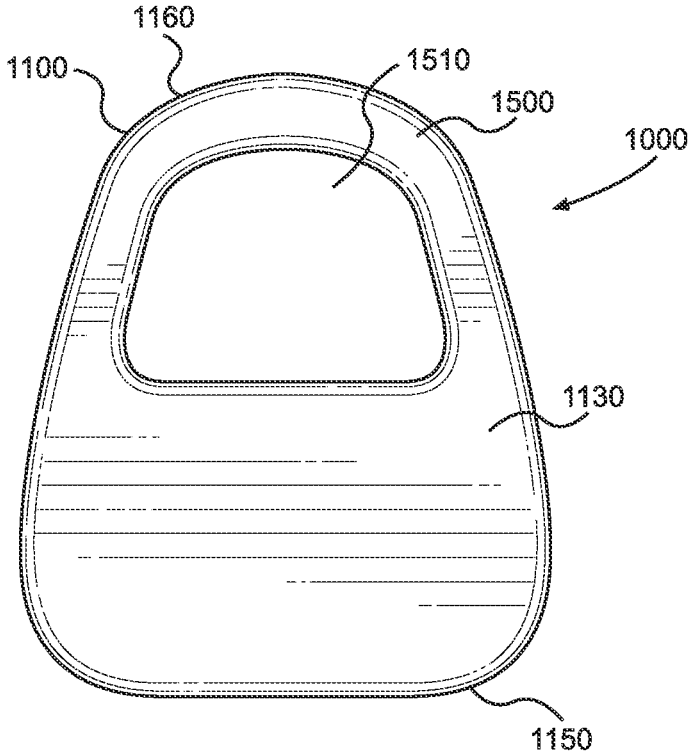
FIG. 3 shows a rear view of an embodiment of the shotgun shell loading and holding device.

Referring now to FIG. 3, there is shown a rear view of an embodiment of the shotgun shell loading and holding device. In the illustrated embodiment, the rear side 1130 of the pad 1100 is entirely flat to enable the shells to remain upright when the rear side of the pad 1100 is placed on a horizontal surface. In the shown embodiment, the openings are disposed at the first end 1150 of the pad 1100 and a tab portion 1500 extends along the second end 1160 thereof. The tab portion 1500 is configured to allow a user to manually grasp and manipulate the device 1000. The tab portion 1500 is formed from the rounded second end of the pad 1100 and comprises an aperture 1510 extending from the front to the rear side 1130 of the pad 1100.

Figure 4:
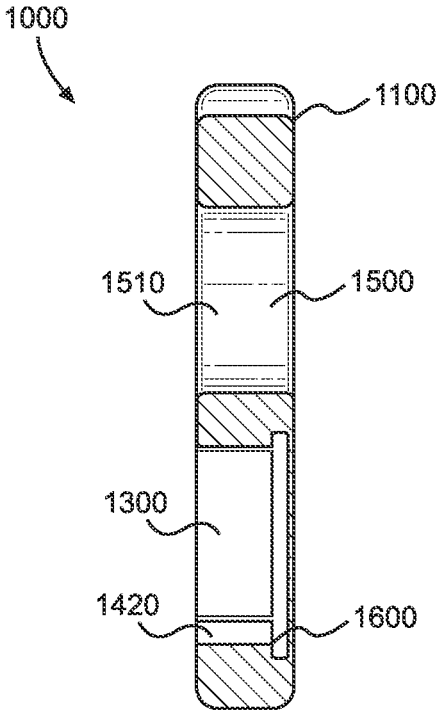
FIG. 4 shows a cross-sectional view of an embodiment of the shotgun shell loading and holding device taken from FIG. 1 along line 4-4.
Figure 5:
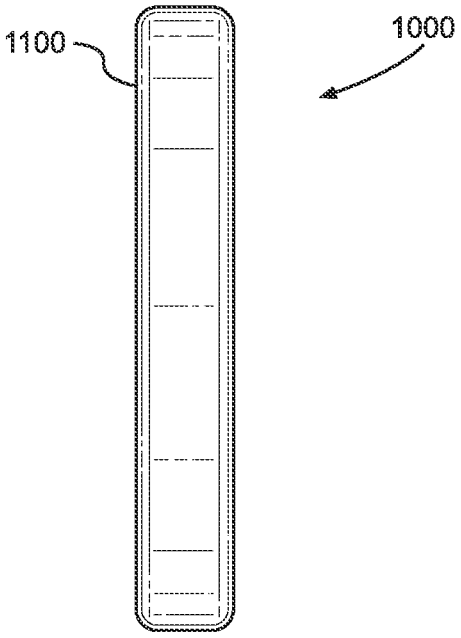
FIG. 5 shows a side view of an embodiment of the shotgun shell loading and holding device.

Referring now to FIGS. 4 and 5, there is shown a cross-sectional view of an embodiment of the shotgun shell loading and holding device taken from FIG. 1 along line 4-4 and a side view of an embodiment of the shotgun shell loading and holding device, respectively. In the illustrated embodiment, the device 1000 further comprises an annular groove 1600 that extends entirely around a base or lower end of each opening 1300, above the floor. The groove 1600 is sized to resiliently and frictionally receive and retain the rim of a shell therein. The groove comprises a circumference larger than the circumference of the opening.

In the illustrated embodiment, the upper rim of each opening 1300 terminates at the surface of the front side of the pad 1100. However, in alternate embodiments, it is contemplated that the rim extends outward from the surface of the front side to lengthen the vertical wall of the opening and provide more surface area for frictionally engaging with the shell of a shotgun.

Figure 6:
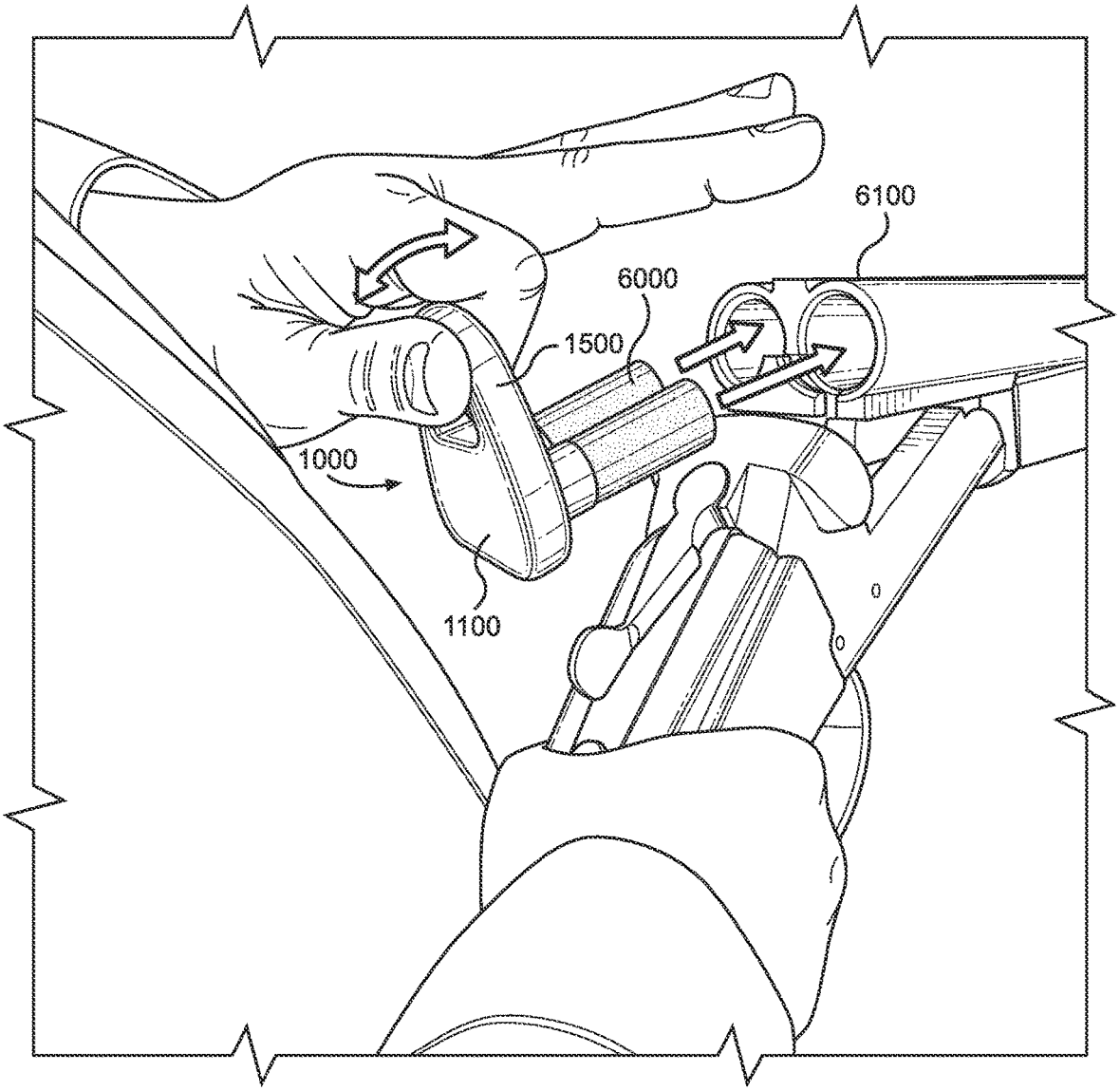
FIG. 6 shows a side view of an embodiment of the shotgun shell loading and holding device in use.

Referring now to FIG. 6, there is shown a perspective view of an embodiment of the shotgun shell loading and holding device in use. The expansion joints and material of the pad facilitate the insertion and release of the shells, whereas the groove and size of the openings serve to frictionally retain the shells within the device. In operation, the shotgun shell loading and holding device 1000 is loaded with a pair of shells by placing each shell 6000 within an opening of the pad 1100. The user grasps the pad 1100 via the top portion 1500 and aligns the shells 6000 with the respective barrels 6100 of a shotgun. The expansion joints and elastomeric material operate to facilitate the insertion and release of the shells, and the material properties, circular openings, vertical walls, and basal grooves further operate to frictionally retain the shells in an interference fit within the circular openings of the device.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shotgun shell loading and holding device, comprising:

a pad having a front side, a rear side and a sidewall extending therebetween;

a pair of openings disposed on the front side of the pad, wherein each opening is configured to receive and retain a rim of a shotgun shell and to release the shotgun shell into a barrel of a shotgun;

wherein the pad comprises a first end and an opposite second end, wherein the pair of openings are disposed on the first end and a projecting tab portion is formed with an aperture therethrough at the second end;

wherein the aperture is configured to receive a finger therethrough to facilitate manual grasping and manipulation of the pad;

wherein the sidewall extends entirely around the pad and comprises a flat end disposed at a distal-most portion of the first end of the pad and a rounded end disposed at a distal-most portion of the second end of the pad;

wherein the pad is composed of an elastomeric material.

2. The device of claim 1, wherein the sidewall extends entirely around the pad and comprises a flat end and a rounded opposite end.

3. The device of claim 1, wherein each opening comprises a floor and vertical wall disposed within the pad.

4. The device of claim 3, further comprising at least one expansion joint disposed at a rim of each opening on towards the front side.

5. The device of claim 3, further comprising a plurality expansion joints disposed around a circumference of a rim of each opening on towards the front side.

6. The device of claim 5, wherein the plurality of expansion joints is each disposed at different distances from one another around the circumference of the upper rim.

7. The device of claim 3, further comprising a laterally extending annular groove from the front side.

8. The device of claim 7, wherein the annular extending groove is disposed within the base of each opening, the groove configured for resiliently and frictionally retaining a shell within the opening.

9. The device of claim 4, wherein the expansion joint and the elastomeric material are configured to facilitate the insertion and the release of each shotgun shell.

10. The device of claim 4, wherein the elastomeric material, the opening, the vertical wall, and the groove are adapted to cooperatively and frictionally retain the shell in an interference fit within the openings of the device.

* * * * *